United States Patent [19]

Bamburg et al.

[11] 4,260,071

[45] Apr. 7, 1981

[54] BULK MATERIAL CONTAINER

[75] Inventors: Robert A. Bamburg, Hebert; Farris N. Duncan, West Monroe; Roger M. Floyd, Monroe, all of La.

[73] Assignee: Manville Forest Products, Dover, Del.

[21] Appl. No.: 65,815

[22] Filed: Aug. 13, 1979

[51] Int. Cl.[3] ..... B65D 5/58

[52] U.S. Cl. ..... 220/445; 206/586; 220/443; 229/23 R; 229/45 R; 229/DIG. 1

[58] Field of Search ..... 229/23 R, 45 R, 23 BT, 229/47, 37 R, DIG. 1; 220/441, 443, 445, 415, 416; 206/586, 320, 326

[56] References Cited

U.S. PATENT DOCUMENTS

| | | | |
|---|---|---|---|
| 1,786,189 | 12/1930 | Bowersock | 206/586 |
| 1,924,529 | 8/1933 | Wellman | 229/37 R |
| 2,214,220 | 9/1940 | Beaman | 229/47 X |
| 2,630,263 | 3/1953 | Ringler | 229/45 X |
| 2,950,038 | 8/1960 | Rupp | 206/586 X |
| 3,073,500 | 1/1963 | Goodrich et al. | 229/49 X |
| 3,337,111 | 8/1967 | Petriekis et al. | 206/586 |
| 3,643,856 | 2/1972 | Jones | 220/441 X |
| 3,726,467 | 4/1973 | Shepherd | 229/37 R X |
| 3,744,702 | 7/1973 | Ellison | 229/23 R |
| 3,910,482 | 10/1975 | Bamburg et al. | 220/443 X |

*Primary Examiner*—Allan N. Shoap

*Attorney, Agent, or Firm*—Robert M. Krone; Joseph J. Kelly; Norvell E. Von Behren

[57] ABSTRACT

A bulk material container is disclosed which includes an exterior body and an interior body having separation means associated with the exterior and interior bodies to provide protection from punctures and to provide for expansion of the products packaged within the interior body. The interior body comprises a first inner liner and a second outer liner laminated together in a predetermined manner to provide a stress reduction means in the interior body. The stress reduction means is formed by offsetting the inner and outer liner manufacturing joints from each other a predetermined distance to provide a triple thickness at the two manufacturing joints along a portion of one of the upstanding walls of the interior body. A topcap with water proofed corners and a retention area for a banding strap may be used with the container and when used the topcap also has means for being interlocked to the exterior body of the bulk material container.

2 Claims, 12 Drawing Figures

225
222
206
208
204
224
24
232
230
214
196
216
188
223
200
192
190
194
184
176
178
186
175
180
182
202
218
226
198
220
228
234
210
205
236
212

10
24
230
11
232
252
26
32
11
254

130
122
114
136
112
128
120
134
110
126
118
108
132
106
116
124
100
144
98
142
96
140
94
138
150
148
146
145
156
154
152
102
104
18

164
174
162
172
160
170
158
168
166
16

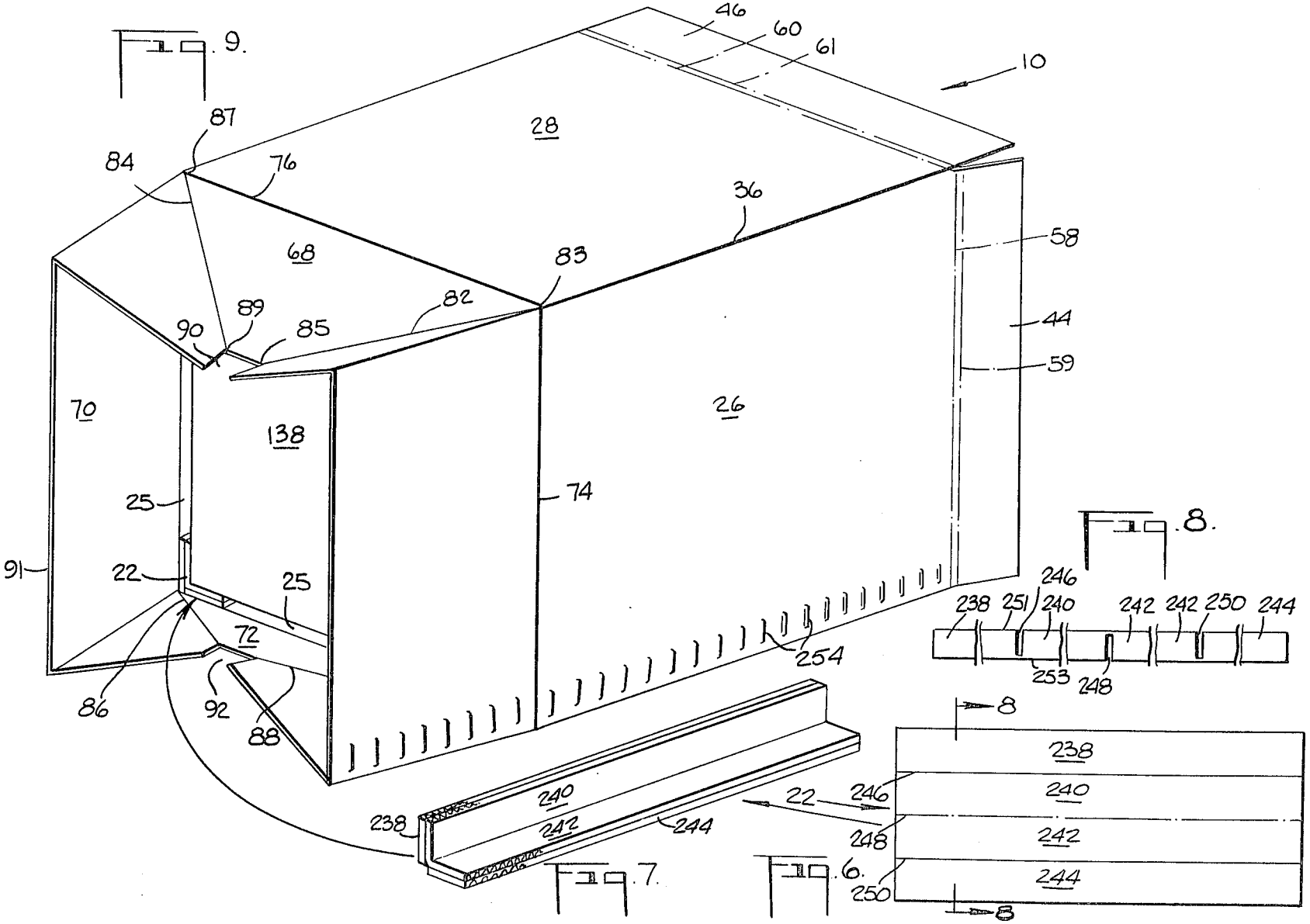
10
58
44
59
46
60
61
36
26
28
83
74
82
68
85
76
87
89
90
84
138
25
72
88
92
86
22
70
91
254
244
240
242
238
8.
9.
7.
6.
246
248
250
251
253

BULK MATERIAL CONTAINER

BACKGROUND OF THE INVENTION

This invention relates generally to bulk material containers and more particularly to a new and novel bulk material container comprising an exterior body and an interior body with stress reduction means formed on the interior body and with separation means provided between the bodies to provide increased protection from punctures and to provide for expansion of the products packaged within the interior body.

In the packaging of magnesium salt coated granules or other petrochemicals or granular products requiring moisture resistance in domestic or export use, the container utilized may weigh as much as 2,000 lbs. or more and may be stacked at least 3 high in a warehouse, yard storage, and dock storage. When stacked in this manner at these weights, it can be seen that the container must withstand pressures of stacking which can be extremely high. In addition, the container must be designed for protection from punctures from the exterior of the container and the container must be designed so that expansion of the products contained within the package does not damage the package especially when stacked as before mentioned.

Many designs have been incorporated in attempts to provide all of the features desired with the various designs meeting with limited success over the years.

Other prior art methods utilized 50 lb. bags being shrink wrapped to a pallet which exposed the product contained within the bags to storage and material handling damage.

SUMMARY OF THE INVENTION

In order to overcome the problems encountered with before mentioned prior art material handling methods, there has been provided by the subject invention a new and novel improved bulk material container which comprises an interior body positioned within and separated from an exterior body by means of a plurality of posts which serve as a separation means to provide protection from puncture, moisture, and further to allow for expansion of the product packaged within the body. The interior body comprises a first inner liner and a second outer liner laminated together to provide stress reduction means in the interior body thereby adding strength to the walls of the bulk container and aiding in alignment during the laminating operation of production.

The exterior body is designed with a partial bellows bottom which serves to prevent the entry of water in the corners of the body and may have a topcap having a plurality of gusset panels which serve to provide water proof corners to the top of the exterior body of the container. The topcap may be locked to the exterior body with a cut out portion which serves as a retention means for positioning a banding strap and further securing the topcap to the bulk material container.

The bulk material container also contains a stress reduction means in the interior body which comprises a pair of manufacturing joints being positioned in the inner and outer liner of the interior body with the manufacturing joints being offset from each other a predetermined distance to provide a triple thickness at the two manufacturing joints along a portion of one of the upstanding walls of the interior body.

The applicants improved bulk material container provides increased protection from punctures, provides for expansion of the product packaged within the interior body of the bulk container, and also offers protection from moisture making the container especially suitable for shipping and storing of other petrochemical or granular products requiring special handling.

Accordingly, it is an object of the invention to provide a new and novel improved bulk material container having structural stability to withstand stacking pressures exerted by warehouse or dockside storage wherein the containers are stacked at least 3 high and the product in each container may weigh at least 2,000 lbs. or more.

Another object of the invention is to provide a new and novel bulk material container having an exterior body constructed with a partial bellows bottom which provides water proof corners in the container to aid in preventing water from entering the container.

Yet another object and advantage of the invention is to provide a new and novel bulk material container having an interior body formed by a first inner liner and a second outer liner which are laminated together in such a manner as to provide a stress reduction means in the container wherein the manufacturing joints formed in the first inner liner and the second outer liner are offset from each other a predetermined distance to provide a triple thickness along a portion of one wall of the interior body adding structural strength to the walls of the bulk material container.

Still yet another object and advantage of the invention is to provide a new and novel bulk material container wherein there is formed within the container a separation means positioned between an inner and exterior bodies of the container with the separation means creating an air cell or chamber in the container which allows for expansion of the product packaged within the interior container while also offering additional protection from external punctures or moisture that may enter the container from the exterior.

Still yet another object and advantage of the invention is to provide a new and novel bulk material container which may be provided with a topcap which has leak proof corners and a retention area for positioning a banding strap to secure the topcap to the bulk material container.

These and other objects and advantages of the invention will become apparent from a review of the drawings and from a study of the preferred embodiment described hereinafter which has been given by way of illustration only.

BRIEF DESCRIPTION OF THE DRAWINGS

FIG. 6 is a plan view of the production blank of the corner post associated with the applicants' bulk material container;

FIG. 7 is a perspective view of the corner post shown in FIG. 6 of the drawing showing the corner post folded to the position in which it would be used in the bulk material container;

FIG. 8 is a section view taken along line 8—8 of FIG. 6 showing the scores used in forming the corner post of the applicants' invention;

FIG. 9 is a perspective view showing the applicants' new and novel bulk material container looking into the bottom of the container and showing the partial bellows bottom formed on the container;

DESCRIPTION OF THE PREFERRED EMBODIMENT

Figure 1:
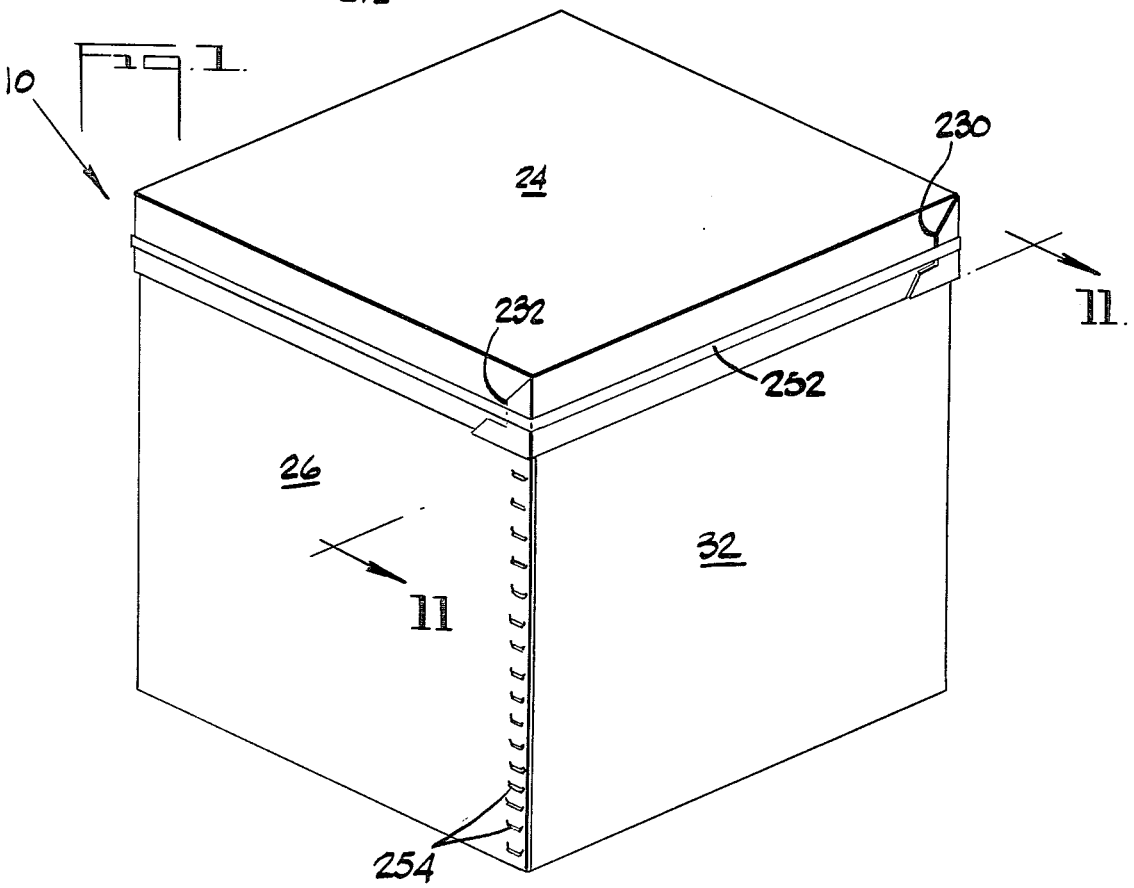
FIG. 1 is a perspective view of the applicants' bulk material container showing the container with a topcap secured and banded thereto.
Figure 2:
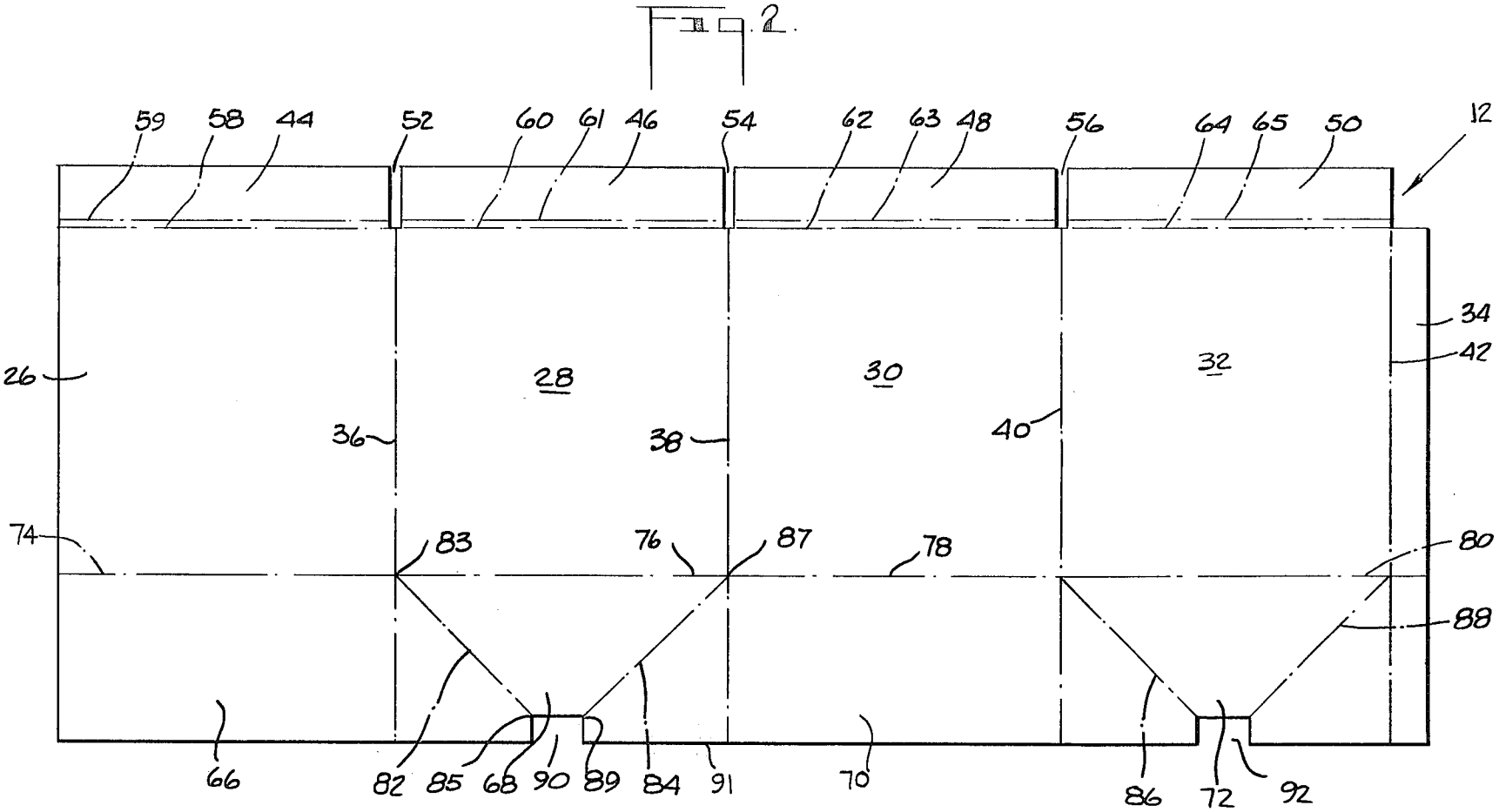
FIG. 2 is a plan view of a production blank of the exterior body of the applicants' bulk material container.

Referring now to the drawings in general and in particular to FIGS. 1 and 2 there is shown the applicants' new and novel bulk material container shown generally by the numeral 10 which comprises an exterior body shown generally by the numeral 12 and shown more in detail in FIG. 2 of the drawing. The exterior body 12 may have applied thereto a topcap or lid 24 which may be banded in place by a banding strap 252 as will be described more fully hereinafter.

The exterior body 12 is formed from a series of upstanding wall panels 26, 28, 30, and 32 and also has formed thereon an adjoining flap 34. The wall panel 26 is hingedly attached to the wall panel 28 by means of the score line 36 while the wall panel 28 is hingedly attached to the wall panel 30 by means of the score line 38. In a similar manner the wall panel 30 is hingedly attached to the wall panel 32 by means of the score line 40 while the wall panel 32 is hingedly attached to the adjoining flap 34 by means of the score line 42. In the assembly of the exterior body, the wall panel 26 would be joined to the adjoining flap 34 by means of a plurality of staples 254 as shown in FIG. 1 of the drawing or may be glued thereto by glue means well known in the art.

Formed along the top edge of the upstanding wall panels 26, 28, 30 and 32 are a plurality of top flaps 44, 46, 48 and 50. The top flap 44 is separated from the top flap 46 by means of the slot 52 while the top flap 46 is separated from the top flap 48 by means of the slot 54. In a similar manner the top flap 48 is separated from the top flap 50 by means of a slot 56.

The exterior body 12 as well as the remaining parts of the applicants' invention with the exception of the banding strap 252 and the staples 254 are generally formed of corrugated paper board but may be formed of other materials within the scope of the invention. Because of the thickness of the corrugated paper board necessary, it is preferable to hinge the top flaps 44, 46, 48 and 50 from their respective wall panels 26, 28, 30 and 32 by a series of double score lines. For example, the top flap 44 would be hinged from the wall panel 26 by means of the pair of score lines 58 and 59 in a similar manner the top flap 46 would be hinged from the wall panel 28 by means of a pair of score lines 60 and 61. The top flap 48 would also be hinged from its adjacent wall panel 30 by means of the pair of score lines 62 and 63 while the top flap 50 would be hinged from its adjacent wall panel 32 by means of the pair of score lines 64 and 65.

Formed on the bottom portion of the exterior body 12 is a plurality of bottom flaps 66, 68, 70 and 72 as shown in FIG. 2 of the drawing. The bottom flap 66 is hingedly attached to the wall panel 26 by means of the score line 74 while the bottom flap 68 is hingedly attached to the wall panel 28 by means of the score line 76. In a similar manner the bottom flap 70 is hingedly attached to the wall panel 30 by means of the score line 78 while the bottom flap 72 is hingedly attached to the wall panel 32 by means of the score line 80. Two of the bottom flaps 68 and 72 which are positioned on opposed sides of the exterior body 12 whenever the exterior body is erected are utilized to form a partial bellows bottom to the container. The partial bellows bottom is formed by utilizing a pair of diagonal reverse score lines 82 and 84 on the bottom flap 68 and a pair of diagonal reverse score lines 86 and 88 on the bottom flap 72. The diagonal reverse score line 82 extends from a corner 83 adjacent to the wall panel 26 and 28 and terminates at a corner 85 of a U-shaped cutout 90 formed in an outer edge 91 of the exterior body 12. In a similar manner the diagonal reverse score line 84 extends from a corner 87 and terminates at a corner 89 of the before mentioned U-shaped cutout 90.

It can be seen by referring to FIG. 2 and to the bottom flap 72 that the diagonal reverse score lines 86 and 88 are formed in a similar manner as before mentioned by extending from the corners adjacent the wall panel 32 to terminate at the corners of the U-shaped cutout 92 formed in the outer edge 91 of the exterior body 12. The U-shaped cutouts 90 and 92 are preferably also located in proximity to the central portion of the outer edge 91 of the respective bottom flap 68 and 72.

Figure 3:
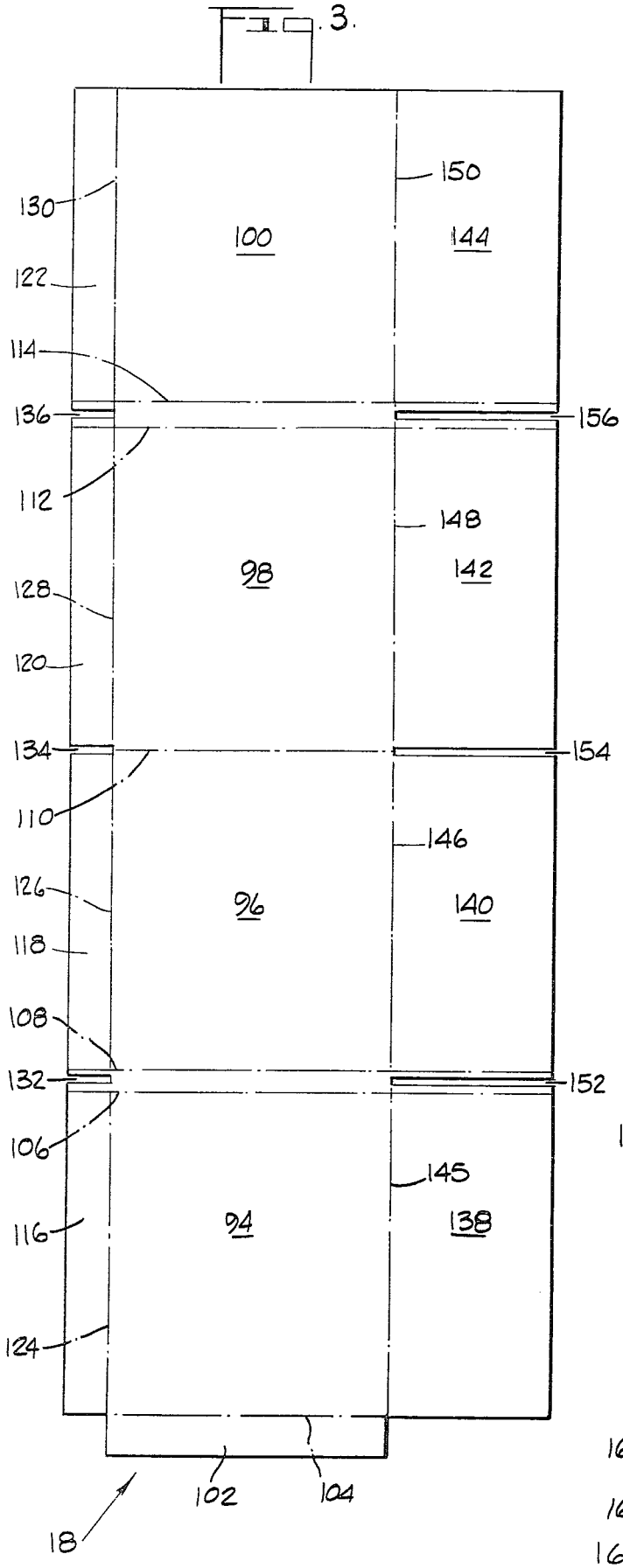
FIG. 3 is a plan view of the production blank of the second outer liner of the interior body of the applicants' invention.
Figure 4:
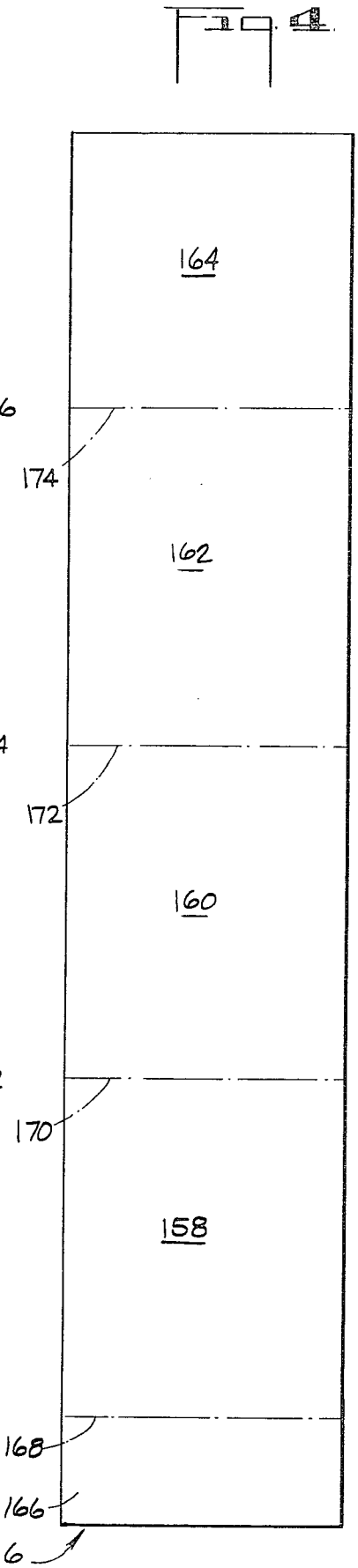
FIG. 4 is a plan view of the production blank of the first inner liner of the interior body of the applicants' invention.

Referring now to FIGS. 3 and 4 of the drawings there is shown the parts forming the interior body of the applicants' bulk material container which is positioned within the exterior body 12 hereinbefore described. The interior body 14 comprises a first inner liner shown generally by the numeral 16 in FIG. 4 of the drawings and a second outer liner shown generally by the numeral 18 in FIG. 3 of the drawings. These liners are laminated together in a predetermined manner to provide a stress reduction means in the interior body 14. The laminated position of the first inner liner 16 and the second outer liner 18 and the stress reduction means will be further described when referring to later drawing FIGS. of the applicants' invention and in particular to FIGS. 10, 11 and 12.

Referring again to FIGS. 3 and 4 of the drawing it can be seen that the second outer liner 18 comprises a plurality of wall panels 94, 96, 98, and 100, along with a glue flap 102 which are hingedly attached together. The glue flap 102 is hingedly attached to the wall panel 94 by means of the score line 104 while the wall panel 94 is hingedly attached to the wall panel 96 by means of the spaced apart score lines 106 and 108. The wall panel 96 is hingedly attached to the wall panel 98 by means of the single score line 110 while the wall panel 98 is hingedly attached to the wall panel 100 by means of the spaced apart score lines 112 and 114.

Formed on the top of the second outer liner 18 are a plurality of top flaps 116, 118, 120 and 122 which are hingedly attached to their respective wall panels by means of a plurality of score lines. For example, the top flap 116 is hingedly attached to wall panel 94 by means of the score line 124 while the top flap 118 is hingedly attached to the wall panel 96 by means of the score line 126. In a similar manner the top flap 120 is hingedly attached to the wall panel 98 by means of the score line 128 while the top flap 122 is hingedly attached to the wall panel 100 by means of the score line 130.

The plurality of top flaps are separated from each other by means of a plurality of slots and it can be seen by referring to FIG. 3 of the drawing that the top flap 116 is separated from the top flap 118 by means of the slot 132 while the top flap 118 is separated from the top flap 120 by means of the slot 134. In a similar manner the top flap 120 is separated from the top flap 122 by means of the slot 136.

Formed on the bottom portion of the second outer liner 18 are a plurality of bottom flaps 138, 140, 142 and 144. The bottom flap 138 is hingedly attached to the wall panel 94 by means of the score line 145 while the bottom flap 140 is hingedly attached to the wall panel 96 by means of the score line 146. In a similar manner the bottom flap 142 is hingedly attached to the wall panel 98 by means of the score line 148 and the bottom flap 144 is hingedly attached to the wall panel 100 by means of the score line 150. The plurality of bottom flaps 138, 140, 142 and 144 are separated from each other by means of a plurality of slots 152, 154, and 156.

Referring now to FIG. 4 the drawing there is shown in detail the construction of the first liner 16 which comprises a plurality of wall panels 158, 160, 162 and 164 along with a glue panel 166. The glue panel 166 is hingedly attached to the wall panel 158 by means of the score line 168 and in a similar manner the wall panel 158 is hingedly attached to the wall panel 160 by means of a score line 170. The wall panel 160 is also hingedly attached to the wall panel 162 by means of the score line 172 and in a similar manner the wall panel 162 is hingedly attached to the wall panel 164 by means of the score line 174.

Figure 5:
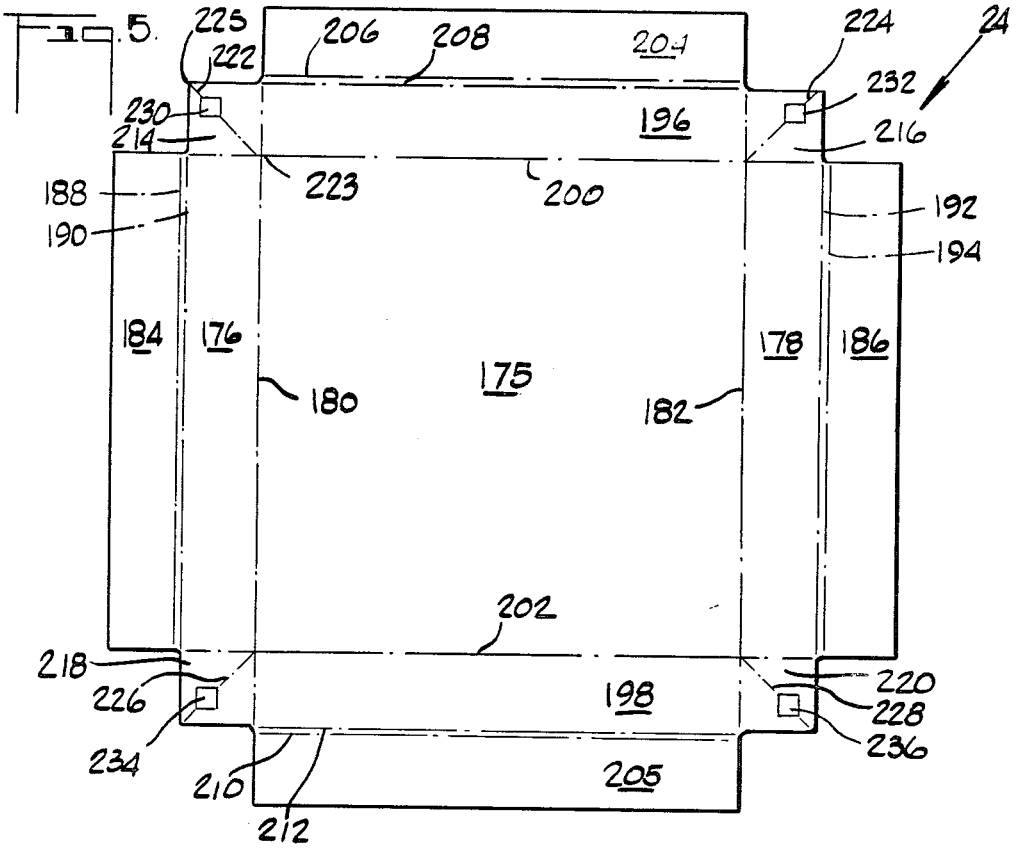
FIG. 5 is a plan view of the production blank for a topcap that may be utilized with the applicants' new and novel bulk material containers.

Referring now to FIG. 5 of the drawing there is shown in detail the construction of the topcap 24 which may be utilized with the applicants' invention and comprises a central panel 175 having hingedly attached thereto a pair of inner side panels 176 and 178 by means of the score lines 180 and 182. Hingedly attached to the inner side panels 176 and 178 are a pair of outer side panels 184 and 186 which are hingedly attached thereto by means of the spaced apart score lines 188 and 190 along with the spaced apart score lines 192 and 194.

The central panel 175 also has hingedly attached thereto a pair of inner end panels 196 and 198 by means of the score lines 200 and 202. The inner end panels 196 and 198 have hingedly attached thereto a pair of outer end panels 204 and 205 hingedly attached thereto by means of the pair of spaced apart score lines 206 and 208 as well as the spaced apart score lines 210 and 212.

The topcap which may be utilized with the applicants' new and novel bulk material container also has means for providing water proof corners with the means further providing a retention area for the banding strap 252. The means for providing water proof corners and the retention area comprises a plurality of gusset panels 214, 216, 218 and 220 which are hingedly connected to their respective inner side panels and inner end panels as shown in FIG. 5 of the drawing. For example, the gusset panel 214 is connected to the inner side panel 176 and the inner end panel 196 by means of the score lines 180 and 200 and in a similar manner the gusset panel 216 is connect to the inner side panel 178 and is connected to the inner end panel 196 by means of the score lines 182 and 200. On the opposite sides of the central panel 175, the gusset panel 218 is hingedly connected to the inner side panel 176 and the inner end panel 198 by means of the score lines 180 and 202 while the gusset panel 220 is connected to the inner side panel 178 and the inner end panel 198 by means of the score lines 182 and 202. Each of the gusset panels 214, 216, 218 and 220 contains a diagonal score line which extends from an inner most corner adjacent to central panel to an outer corner of the gusset panel as shown in FIG. 5 of the drawing. For example, the gusset panel 214 contains a diagonal score line 222 extending from the inner most corner 223 to an outer corner 225 of the gusset panel 214. In a similar manner the gusset panel 216 contains the diagonal score line 224 while the gusset panel 218 contains the diagonal score line 226 and the gusset panel 220 contains the diagonal score line 228.

Formed in the gusset panels are cutout portions or retention areas 230, 232, 234 and 236 in a position shown in the drawing FIG. 5. By referring to FIG. 1 of the drawing, it can be seen how the retention areas or cutout portions 230, 232, 234 and 236 function whenever the respective gusset panels are folded and the banding strap 252 is positioned around the top cap 24. It can be seen in FIG. 1 of the drawing for example that the retention areas 230 and 232 as well as the retention areas 234 and 236 function to provide a means for aiding the positioning of the banding strap 252 around the topcap 24 whenever the topcap is used with the applicants' new and novel bulk container. The retention areas serve to keep the bandingstrap 252 from sliding upwardly or downwardly on the topcap 24 whenever it is banded in position around the topcap.

Referring now to FIGS. 6, 7, and 8 of the drawing there will be described the separation means associated with the exterior body 12 and the interior body 14 which is utilized to provide increased protection from punctures and to provide for expansion of the products packaged within the interior body 14. The separation means or post are shown generally by the numeral 22 in FIG. 6 and comprise a plurality of panels which are hingedly connected together. The outer panel 238 is hingedly connected to the inner panel 240 by means of the score line 246 while the inner panel 240 is hingedly connected to the inner panel 242 by means of the score line 248. In a similar manner the inner panel 242 is hingedly connected to the outer panel 244 by means of the score line 250. The two inner panels 240 and 242 in the series of four panels are folded in a V-shape about the joining score line 248 and the two outer panels in the series of four panels are folded about their respective score lines 246 and 250 to lie in a face to face relationship with the two folded inner panels 240 and 242.

By referring to FIG. 7 of the drawing it can be seen the just described folding of the four panels 238, 240, 242 and 244 and how the respective panels when folded are ready for position in the bulk material container between the exterior body 12 and the interior body 14. Be referring to FIG. 8 of the drawing it can be seen how the adjoining score lines 246, 248 and 250 of the panels are positioned in order to aid in the folding of the post 22 to the position shown in FIG. 7. It can be seen that the score line 246 and the score line 250 would be scored from the top side 251 of the post 22 while the score line 248 would be scored from the bottom side 253 of the post 22.

Referring now to FIG. 9 of the drawings there can be seen the applicants' complete bulk material container 10 showing the exterior body 12 positioned around and interior body 14 and also showing the partial bellows bottom formed on the bulk material container. There is also shown in FIG. 9 how the post 22 may be positioned in the bulk material container 10 between the exterior body 12 and the interior body 14 to form openings 25 which serve as separation means to provide increased protection from punctures and to provide for expansion of the products packaged within the interior body 14. In the preferred embodiment shown in FIG. 9 of the drawing the separation means are positioned at the corners of the inner section of the exterior body and interior body but it is within the spirit and scope of the invention that may be located in other positions between the exterior body 12 and the interior body 24 in order to provide the necessary separation. For example they could be positioned midway between the adjacent walls of the exterior body and the interior body instead of the corner position shown in FIG. 9 within in the spirit and scope of the invention.

Figure 10:
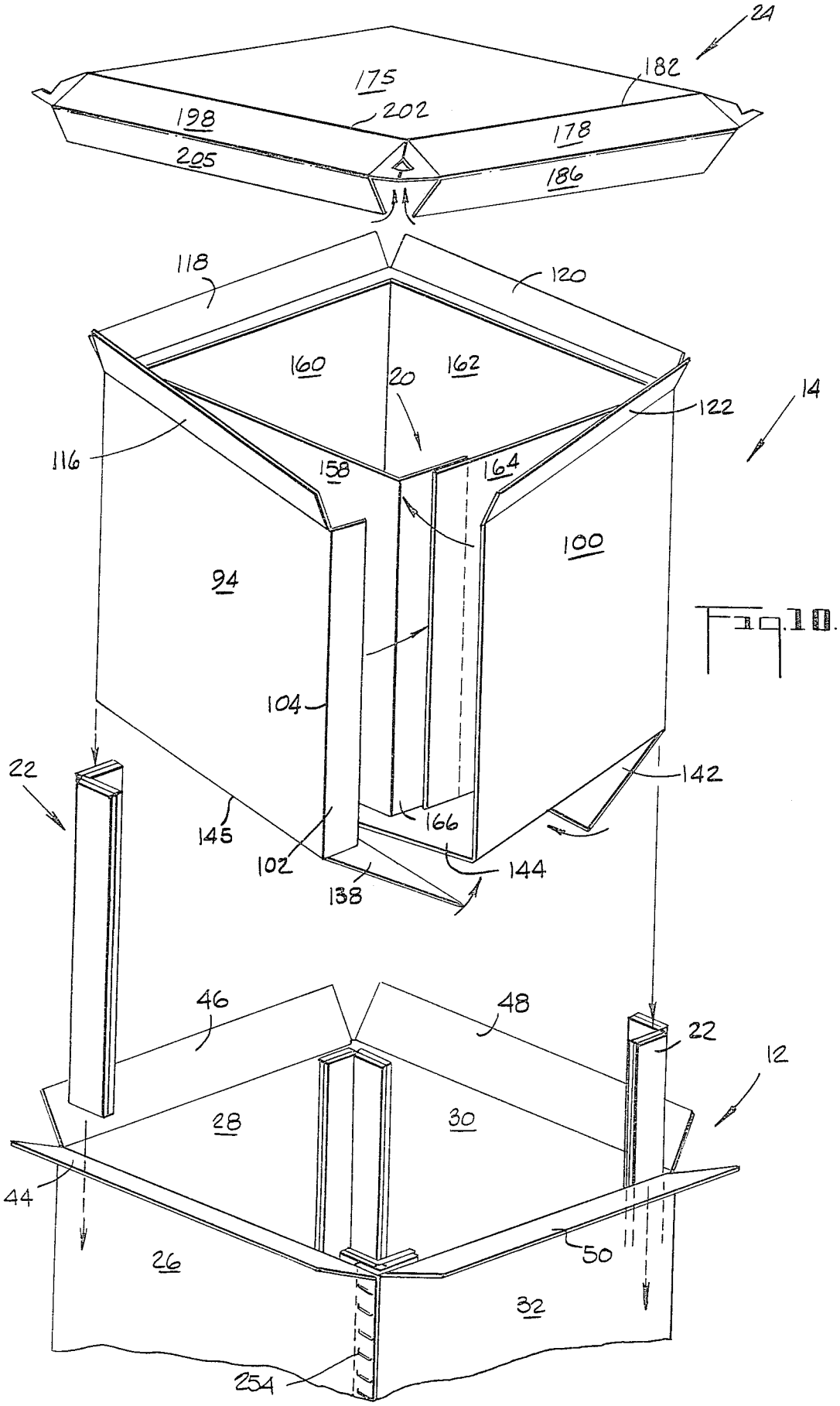
FIG. 10 is an exploded perspective view of the applicants' new and novel bulk material container showing the positioning of the various parts of the container and also showing a topcap which may be utilized with the container.

Turning now to FIG. 10 of the drawing there can be seen an exploded view of the applicants' complete invention shown with a topcap being positioned in place on the top of the bulk material container. There can also be seen in greater detail the positioning of the post 22 in the corners of the exterior body 12 prior to insertion of the interior body 14 in the bulk material container. There can also be seen in FIG. 10 of the drawings the positioning of the stress reduction means of the applicants' invention which comprises a pair of manufacturing joints positioned as shown in FIG. 10 of the drawing and being offset from each other a predetermined distance to provide a triple thickness at the two manufacturing joints along a portion of one of the upstanding walls of the interior body 14. The stress reduction means is shown generally by the numeral 20 in FIG. 10 of the drawings and will be described more fully hereinafter when referring to the drawing FIGS. 11 and 12.

Figure 11:
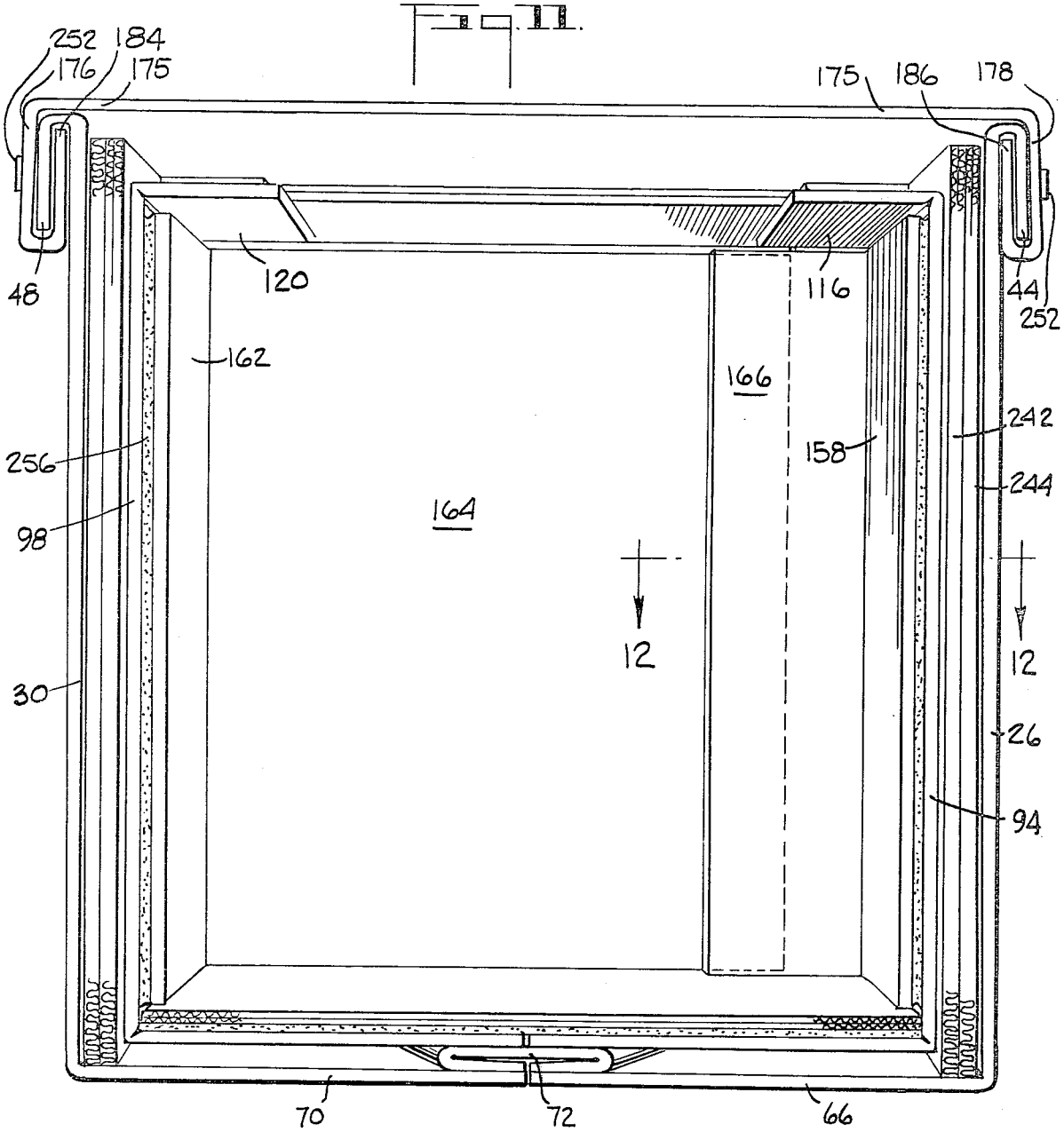
FIG. 11 is a sectional view taken along line 11—11 of FIG. 1 showing the interior of the applicants' container and also showing a topcap position on and locked to the container.

Referring now to FIG. 11 of the drawing there can be seen a cross sectional view taken along line 11—11 of FIG. 1 showing the positioning of the interior body 14 within the exterior body 12 and also showing a positioning of the topcap 24 locked in position on the bulk material container 10. By referring to FIG. 11 it can be seen that whenever a topcap 24 is used with the applicants' bulk material container 10 that the plurality of top flaps 44, 46, 48 and 50 would be turned outwardly and downwardly along the outside of the exterior body 12. Thereafter the topcap 24 would have its inner side panels 176 and 178 along with its inner end panels 196 and 198 turned downwardly into juxtaposition with the top flaps 44, 46, 48 and 50. Thereafter the outer side panels 184 and 186 of the topcap 24 along with the outer end panels 204 and 205 would be turned upwardly and inwardly also in juxtaposition with the top flaps 44, 46, 48 and 50 along with being in juxtaposition with the wall panels 26, 28, 30 and 32. The gusset panels 214, 216, 218 and 220 of the topcap 24 would be folded into the position shown in FIG. 1 of the drawing whereupon a steel or plastic banding strap 252 would be tightly positioned around the entire topcap 24 to rigidly lock the topcap on the bulk material container 10.

Figure 12:
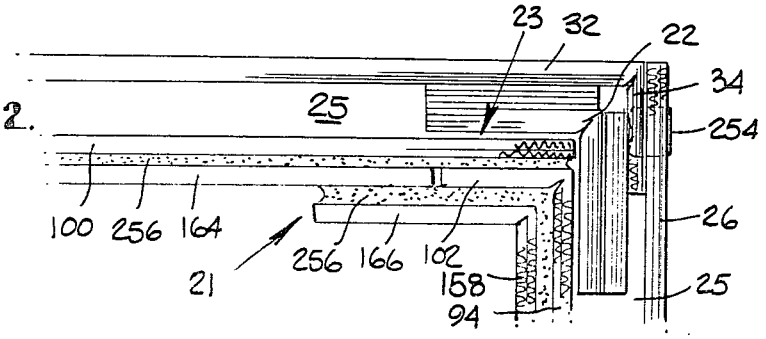
FIG. 12 is a sectional view taken along line 12—12 of FIG. 11 showing the stress reduction means forming a part of the applicants' invention.

By referring now to FIG. 12 of the drawing there can be seen the stress reduction means 20 of the applicants' invention which comprises a first manufacturing joint shown generally by the numeral 21 which is formed in the first interior liner 16 of the interior body by overlapping the glue panel 166 with the wall panel 164 as shown in the FIG. In a similar manner the second manufacturing joint shown generally by the numeral 23, is formed by overlapping the glue flap 102 of the seond outer liner 18 with the wall panel 100. Glue 256 is applied to the areas between the manufacturing joints and also to laminate the first inner liner 16 with the second outer liner 18. The glue 256 is shown by stippling in FIG. 12 of the drawings. The first manufacturing joint 21 and the second manufacturing joint 23 are offset from each other a predetermined distance as shown in FIG. 12 of the drawing to provide a triple wall thickness at the two manufacturing joints along a portion of one of the upstanding walls of the interior body 14. This can be seen where the glue flap 102 of the second outer liner 18 abutts the wall panel 164 of the first inner liner 16 and is sandwiched between the glue panel 166 of the first inner liner and the wall panel 100 of the second outer liner. There can be seen also in FIG. 12 of the drawing how in the preferred embodiment the separation means or post 22 are located in the corners of the bulk material container between the exterior body 12 and the interior body 14 and how the location of the post 22 provides an opening or void space 25 which serves to provide increased protection from punctures and to provide for expansion of the products pacakaged within said interior body.

The interior body 14 may be formed of a single thickness of corrugated material or other material and for additional stacking strength may generally have another thickness of corrugated material laminated thereto fully to the inside of the four inner wall panels 158, 160, 162 and 164. The design of the stress reduction means 20 avoids an unbalanced glue joint in the bulk material container and assures a true fold on the glue joint corner which assists in the alignment of the two sections in the laminating operation of production of the bulk material container. The separating means or post 22 may be of varying thicknesses and styles and their design increases the stacking performance of the bulk material container and also provides an air chamber on each side panel. The function of the air chamber will also be to disperse the heat contained within the bulk material container whenever the unit is loaded with a hot product and also to increase puncture resistance and to act as an insulating chamber from external hot and cold temperatures.

The exterior body of the bulk material container 10 may be waxed, impregnated and/or curtain coated depending upon the degree of weather resistance required and it may also have another thickness of corrugated material laminated thereto and particularly to wall panels 26, 28, 30 and 32 on the inside thereof.

The preferred embodiment shown was designed as an export container to pack 2,240 lbs. of magnesium salt coated granules with the container being designed to withstand 3 high warehouse, yard storage and dockside storage. In addition the container was designed to fit an export cargo-tainer sized 40'×8'×8' with maximum payload. The purpose of the partial overlapped half bellows bottom is to provide two thicknesses of material as a central barrier to water or moisture penetration and the applicants' new and novel bulk material container may be utilized with any petrochemical or granular products which require absolute moisture resistance in domestic or export use. The separation means or post 22 of the applicants' container increase the stacking strength by approximately 16% which allows a reduction in the combination of corrugated liners contained within the container. In other words a lighter weight corrugated board could be utilized for some of the inner liners because of the extra strength afforded by the post 22.

It can be seen from the foregoing that there has been provided by the applicants' invention a new and novel bulk material container having unusual features and functions which allows the container to perform as designed in a variety of applications. Nevertheless it is within the spirit and scope of the invention that many changes may be made in the various parts of the invention and the invention is not to be limited to the embodiment shown which has been shown by way of illustration only.

Having described our invention, we claim:

1. A topcap for a bulk container, said topcap comprising:
   (a) a central panel;
   (b) a pair of opposed inner side panels hingedly attached to said central panel;
   (c) a pair of opposed outer side panels hingedly attached to their respective inner side panels;
   (d) a pair of opposed inner end panels hingedly attached to said central panel;
   (e) a pair of opposed outer end panels hingedly attached to their respective inner end panels; and
   (f) a plurality of gusset panels, each of said gusset panels being hingedly connected to an inner side panel and an inner end panel, each of said gusset panels containing a diagonal score line extending from an innermost corner adjacent the central panel to an outer corner of said gusset panel, each of said gusset panels serving to provide a leak proof corner to the topcap; each of said gusset panels further having a cutout portion along the area defined by said diagonal score line, said cutout portion serving as a retention area for positioning a banding strap and securing the topcap to the bulk material container.

2. A combination bulk material container comprising:
   (a) an exterior body having a series of hingedly connected wall panels, each wall panel having hingedly connected thereto on opposed ends a top flap and a bottom flap, one of said wall panels having a hingedly connected adjoining flap for securing the panels together;
   (b) an interior body formed from a first inner liner and a second outer liner laminated together;
      (i) said first inner liner being formed from a series of hingedly connected wall panels, one of said wall panels having a glue panel hingedly connected thereto for securing the wall panels together;
      (ii) said second outer liner being formed from a series of hingedly connected wall panels, one of said wall panels having a glue flap hingedly connected thereto for securing said panels together;
      (iii) each of said wall panels of said second outer liner having hingedly connected thereto on opposed ends a top flap and a bottom flap;
   (c) stress reduction means formed in said interior body, said stress reduction means comprising;
      (i) a first manufacturing joint formed in the first inner liner of the interior body by the glue panel on said inner liner overlapping and being secured against an adjacent wall panel;
      (ii) a second manufacturing joint formed in the second outer liner of the interior body by the glue flap on said second outer liner overlapping and being secured to an adjacent wall panel on the second outer liner;
      (iii) said first and second manufacturing joints being offset from each other a predetermined distance thereby providing a triple thickness along a portion of one of the walls of the interior body;
   (d) separation means, associated with said exterior and interior bodies, for providing an opening between said exterior and interior bodies to provide additional protection for the products packaged within said interior body;
   (e) a topcap, associated with the top of the exterior body and comprising:
      (i) a central panel;
      (ii) a pair of opposed inner side panels hingedly attached to said central panel;
      (iii) a pair of opposed outer side panels hingedly attached to their respective inner side panels;
      (iv) a pair of opposed inner end panels hingedly attached to said central panel;
      (v) a pair of opposed outer end panels hingedly attached to their respective inner end panels;
      (vi) a plurality of gusset panels, each of said gusset panels being hingedly connected to an inner side panel and an inner end panel, each of said gusset panels containing a diagonal score line extending from an innermost corner adjacent the central panel to an outer corner of said gusset panel, each of said gusset panels serving to provide a leak proof corner to the topcap; the gusset panels further having a cutout portion along the area defined by said diagonal score line, said cutout portion serving as a retention area for positioning a banding strap and securing the topcap to the bulk material container; and
   (f) a banding strap positioned around the topcap and over the retention area to tightly band the topcap to the exterior body.

* * * * *